US005461738A

United States Patent [19]

Kimura et al.

[11] Patent Number: 5,461,738

[45] Date of Patent: Oct. 31, 1995

[54] BED SYSTEM WITH EXCRETING MECHANISM

[75] Inventors: Motoyasu Kimura; Tomoe Kimura, both of Tokyo, Japan

[73] Assignee: Kimura Industry Co., Ltd., Tokyo, Japan

[21] Appl. No.: 22,371

[22] Filed: Feb. 25, 1993

[30] Foreign Application Priority Data

Feb. 28, 1992 [JP] Japan ..... 4-043686
Sep. 24, 1992 [JP] Japan ..... 4-255119

[51] Int. Cl.[6] ..... A61G 7/02

[52] U.S. Cl. ..... 5/604; 5/605; 5/905; 5/81.1

[58] Field of Search ..... 5/604, 605, 81.1, 5/905

[56] References Cited

U.S. PATENT DOCUMENTS

| | | | |
|---|---|---|---|
| 2,564,135 | 8/1951 | Touchberry | 5/605 |
| 3,345,652 | 10/1967 | Hiraga | 5/604 |
| 3,562,824 | 2/1971 | White | 5/604 |

FOREIGN PATENT DOCUMENTS

| | | |
|---|---|---|
| 0363541 | 4/1990 | European Pat. Off. . |
| 2329256 | 5/1977 | France . |
| 58-143751 | 8/1982 | Japan . |
| 63-21056 | 1/1988 | Japan . |
| 63-240859 | 6/1988 | Japan . |
| 3-37423 | 6/1991 | Japan . |
| 3-37422 | 6/1991 | Japan . |
| 3-68698 | 10/1991 | Japan . |

*Primary Examiner*—Alexander Grosz
*Attorney, Agent, or Firm*—Rosen, Dainow & Jacobs; Limited Liability Partnership

[57] ABSTRACT

A bed system with an excreting mechanism of the present invention includes a front base for receiving the upper half of a patient's body and having a first front portion capable of being tilted up or down, a rear base for receiving the lower half of the patient's body and having a second front portion capable of being tilted up or down, a pot seat for supporting the patient's buttocks, a chamber pot for receiving the patient's excretions, and a posture regulating mechanism for regulating the patient's posture. In tilting up of the second front portion of the rear base, the pot seat is positioned between the rear end of the front base and the front end of the rear base, and the chamber pot is positioned under the pot seat. The second portion of the rear base is tilted up or down around the rear edge of the second front portion as a supporting shaft and can be tilted up or down around the front edge of the second front portion as a supporting shaft.

8 Claims, 17 Drawing Sheets

BED SYSTEM WITH EXCRETING MECHANISM

BACKGROUND OF THE INVENTION

The present invention relates to a bed system with an excreting mechanism for use by physically handicapped persons having difficulty excreting.

As an example of a bed with an excreting mechanism of this kind, the present inventor proposed a technique disclosed in Japanese Patent Laid-open Nos. sho 63-168159 and sho 63-240859. According to this technique, a base mounted on a bed is divided into a front base for receiving the upper half of a patient's body and a rear base for receiving the lower half of the patient's body. In excretion, the front edge of the front base is tilted up, and the front end portion of the rear base is raised for correcting the posture of the patient, to thereby position the patient's buttocks on an opening portion between the front base and the rear base. This makes it possible for the patient to excrete with respect to a chamber pot disposed under the opening portion.

The present inventor has studied a bed system with an excreting mechanism of the above-described type and has found that the above technique still has the following technical problem.

Namely, the patient is physically and psychologically uneasy when he is in an unstable position during excretion, and excretion is more difficult in such a position. The prior art, however, has not adequately addressed this point.

More specifically, in the prior art, the bed was tilted up or divided without taking into account the position of the patient lying on the bed. As a consequence, the patient's posture was unstable and he suffered discomfort and mental anguish during excretion.

Also, since the patient's buttocks were unstably positioned at the opening portion of the bed, the patient was often forced to excrete in an unnatural position.

Further, the prior art did not consider the posture of the patient when he is returned to his usual position in bed after excretion. It is possible in the prior art embodiment for the patient's buttocks to be pinched after excretion between the divided bases of the bed.

SUMMARY OF THE INVENTION

An object of the present invention is to provide a bed system with an excreting mechanism capable of stably regulating the patient's posture.

Another object of the present invention is to provide a bed system with an excreting mechanism which permits easy inspection of the excretions.

A further object of the present invention is to automate the operation of the bed system in excretion, and hence to reduce the labor of a patient and an attendant.

The bed system with an excreting mechanism has a front base for receiving the upper half of a patient's body and capable of being tilted up, and a rear base for receiving the lower half of the patient's body and capable of being tilted up at its front portion. The rear base is movable forward and backward. A pair of rollers are provided in the vicinities of the front peripheral portion and the rear peripheral portion of the front base. A bed sheet is stretched between the rollers so as to be movable forward and backward by rotation of the rollers.

A posture regulating mechanism is comprised of the above rollers, the bed sheet, and a roller drive means for driving the rollers.

A pot seat is provided at an opening portion between the rear peripheral portion of the front base and the front peripheral portion of the rear base when the front base is tilted up, and the rear base is moved backward to tilt up the front portion of the rear base. The pot seat is provided with a cover at both ends thereof and may be moved integrally with the cover up and down with the tilting up and tilting down of the front portion of the rear base. Further, the pot seat and the cover are movable toward both sides. A chamber pot is disposed under the pot seat in such a manner that the upper surface is opened and closed with the tilting up and tilting down of the front portion of the rear base.

By operation of the roller drive means of the above posture regulating mechanism, the rollers are rotated, and the bed sheet stretched between the rollers is moved forward and backward in the manner of a conveyer belt. Accordingly, the position of the patient, that is, the patient's posture is regulated. The front base is then tilted up and the rear base is retracted to tilt up the front portion of the rear base. Further, by seating the patient's buttocks on the pot seat between the front base and the rear base, it is possible to regulate the patient's posture in excretion.

Further, the bed system of the present invention may be modified as follows:

The bed system includes a front base for receiving the upper half of a patient's body and has a first front portion capable of being tilted up, and a rear base for receiving the lower half of the patient's body and has a second front portion capable of being tilted up. Further, the bed system includes a pot seat for supporting the patient's buttocks, and a chamber pot for receiving the patient's excretions.

The pot seat is positioned between the rear peripheral portion of the front base and the front peripheral portion of the rear base in tilting up of the second front portion of the rear base. The chamber pot is disposed under the pot seat. Also, the second front portion of the rear base is tilted up and tilted down around the rear end of the second front portion as a supporting shaft and can be tilted up and tilted down around the front peripheral portion of the second front portion as a supporting shaft.

At least one of the front base and the rear base is disposed so as to be movable forward and backward. The front base is moved forward or the rear base is moved backward, and the pot seat is provided at the opening portion formed between the rear peripheral portion of the front base and the front peripheral portion of the rear base when the second front portion of the rear base is tilted up.

The front base may be formed so as to be freely tilted downwardly of the horizontal position.

Also, there is provided a posture regulating mechanism including a pair or plural pairs of rollers provided in the vicinities of the right and left side portions of the front base, a sheet stretched between the rollers so as to be movable rightward and leftward by rotation of the rollers, and a roller drive meals for driving the rollers.

The chamber pot is formed in such a manner that the upper surface is opened and closed with the tilting up and tilting down of the second front portion of the rear base.

Also, there may be disposed a transparent window on the side surface of the chamber pot for freely observing the excretions, and an illuminating device outside or inside the chamber pot for lighting the inside of the chamber pot, and an image pick-up device for picking up an image of the inside of the chamber pot.

Further, preferably, the chamber pot is provided with a water supply device for supplying water for flushing the inside of the chamber pot, a drain device for discharging the flushing water or the excretions within the chamber pot, and a jetting device for washing and drying the patient's private parts.

The system includes position detecting sensors provided in the vicinity of the front base and the rear base for detecting the patient's position, a centralized control unit for inputting signals from the position detecting sensors, a front base drive means for moving the front base and tilting up and tilting down the first front portion of the front base, and a rear base drive means for tilting up and tilting down the second front portion of the rear base. The centralized control unit analyzes the signals from the position detecting sensors, calculates the correction amount, and supplies the correction amount as drive signals to the roller drive means and the front base drive means for regulating the patient's posture. Also, the centralized control unit outputs the drive signals to the front base drive means and the rear base drive means for moving forward and tilting up the front base and tilting up the rear base. Further, the centralized control unit outputs operational signals to the illuminating device and the image pick-up device for picking up an image of the inside of the chamber pot.

The front base is advanced or the rear base is retracted, to tilt up the first front portion of the front base. Also, the second front portion is tilted-up around the rear peripheral portion of the second front portion of the rear base as a supporting shaft. Further, by seating the patient's buttocks on the seat positioned between the rear peripheral portion of the front base and the front peripheral portion of the rear base, a patient's posture in excretion is regulated. At this time, the chamber pot is disposed under the pot seat, to receive the patient's excretions.

Also, by tilting-up the second front portion of the rear base around the front end of the second front portion during the non-excretion stage, it is possible to easily raise the lower half of the patient's body.

DESCRIPTION OF THE PREFERRED EMBODIMENT

Hereinafter, preferred embodiments of the present invention will be described.

Embodiment 1

A first embodiment of the present invention will be described with reference to FIGS. 1 to 8.

Figure 1:
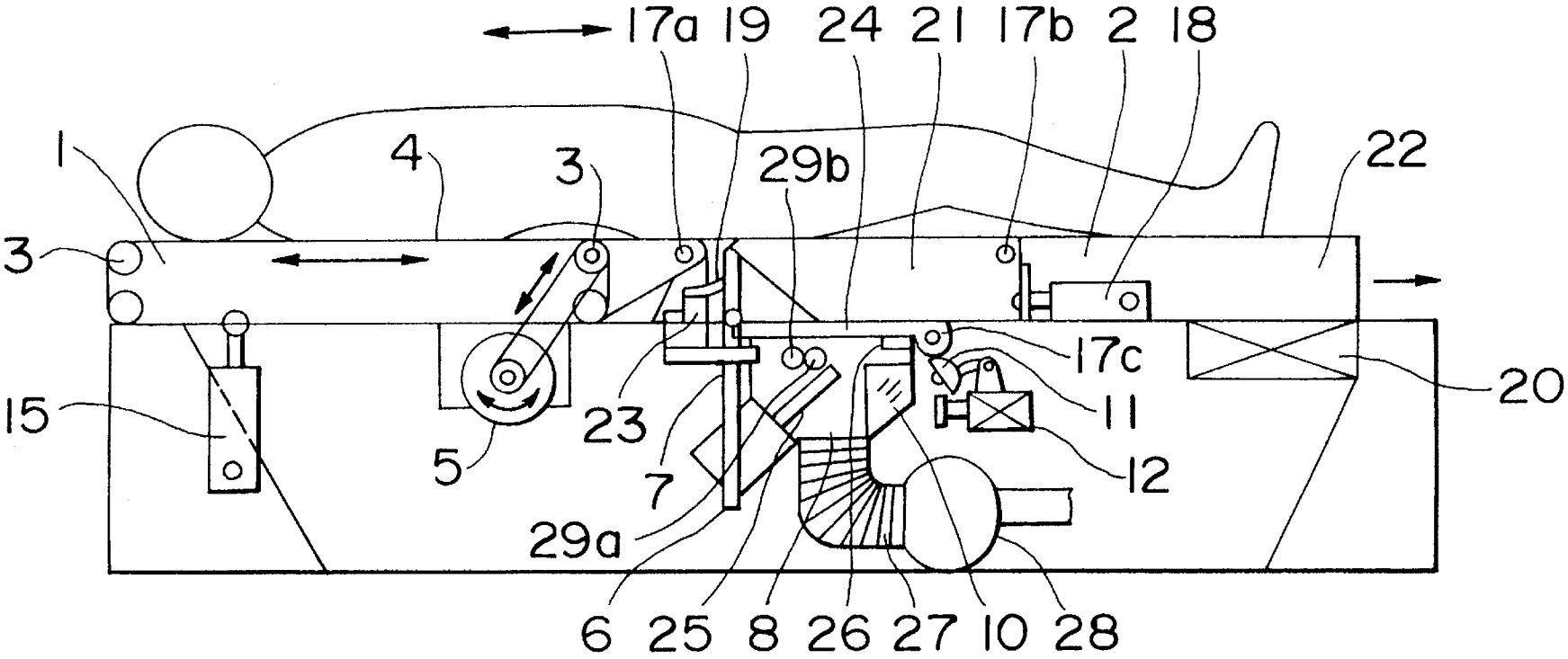
FIG. 1 is a schematic structural view of a bed system according to a first embodiment of the present invention showing a bed in the non-excreting position.

FIG. 1 is a schematic view showing the mechanism of a bed system of this embodiment. The upper surface of a bed comprises a front base 1 and a rear base 2.

First, there will be described the peripheral construction of the front base 1 provided with a posture regulating mechanism which is one of the features of this embodiment.

Two pairs of rollers 3 and 3 are disposed in the vicinities of the front peripheral portion and the rear peripheral portion of the front base 1, respectively. The rollers 3 and 3 are rotated by a roller drive motor 5 as a roller drive means. A bed sheet 4 is provided to be stretched between two pairs of rollers 3 and 3. By rotation of the rollers 3 and 3 by means of the above roller drive motor 5, the bed sheet 4 is moved forward and backward. Since the gravity or bulk of the weight of the patient's body lying on the bed is positioned above the buttocks, it is possible to move the patient, that is, regulate the patient's posture by movement of the bed sheet 4 of the front base 1 on which the upper half of the patient's body lies. Incidentally, the posture regulating mechanism in this embodiment may be used as a patient moving means for inspection or exchange of the bed sheet, in addition to the excreting means.

A front base drive actuator 15 (front base drive means) for tilting up the front base 1 is provided on the lower portion of the front base 1 in the vicinity of the front peripheral portion thereof. The front base drive actuator 15 is intended to raise the front peripheral portion of the front base 1 around a supporting shaft 17*a* as a fulcrum using a cam mechanism or hydro-power.

Next, the peripheral construction of the rear base 2 will be described.

The rear base 2 comprises a front portion 21 and a rear portion 22. The front portion 21 can be tilted up by a rear base drive actuator 18 (rear base drive means). Also, the rear portion 22 can be moved forward and backward by a rear base moving motor 20 (rear base drive means).

The front portion 21 and the rear portion 22 of the rear base 2 are connected to each other by means of a supporting shaft 17*b*. Accordingly, forward and backward movement of the rear base 2 is accomplished when the front and rear portions 21 and 22 are connected to each other. The front portion 21 can be raised around the supporting shaft 17*b* by means of the rear base drive actuator 18, independently of the rear portion 22.

Figure 4:
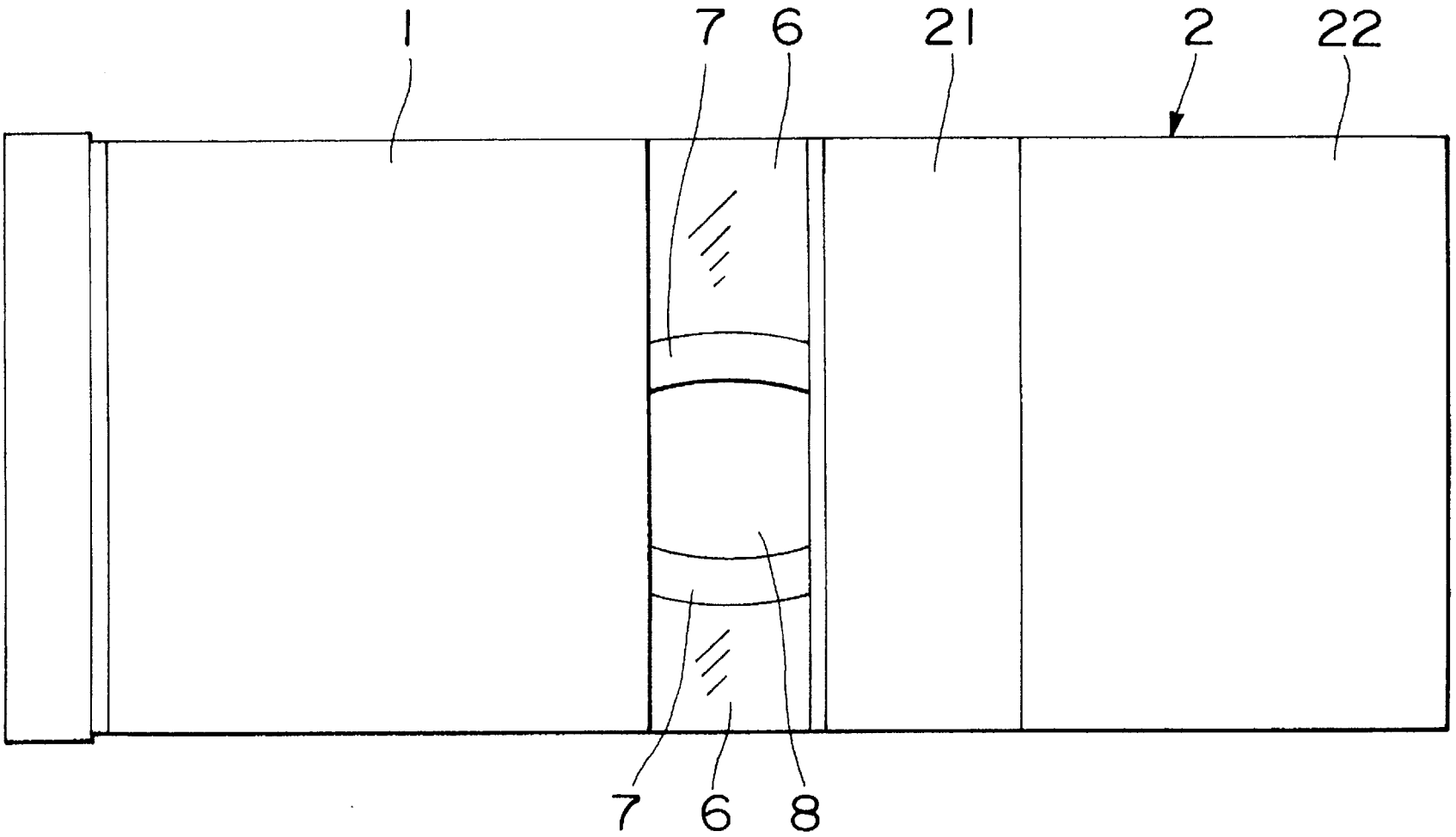
FIG. 4 is a plan view of the bed system of the first embodiment positioned for use during excretion.

A pot seat 7 having an opening shape as shown in FIG. 4 is provided on the front peripheral portion of the rear base 2 so as to be substantially perpendicular to the rear base 2. A plate-like cover 6 is provided around the above pot seat 7. The cover 6 is intended to preserve the patient's privacy and prevent the patient's buttocks from being directly exposed to the outside air.

Figure 5:
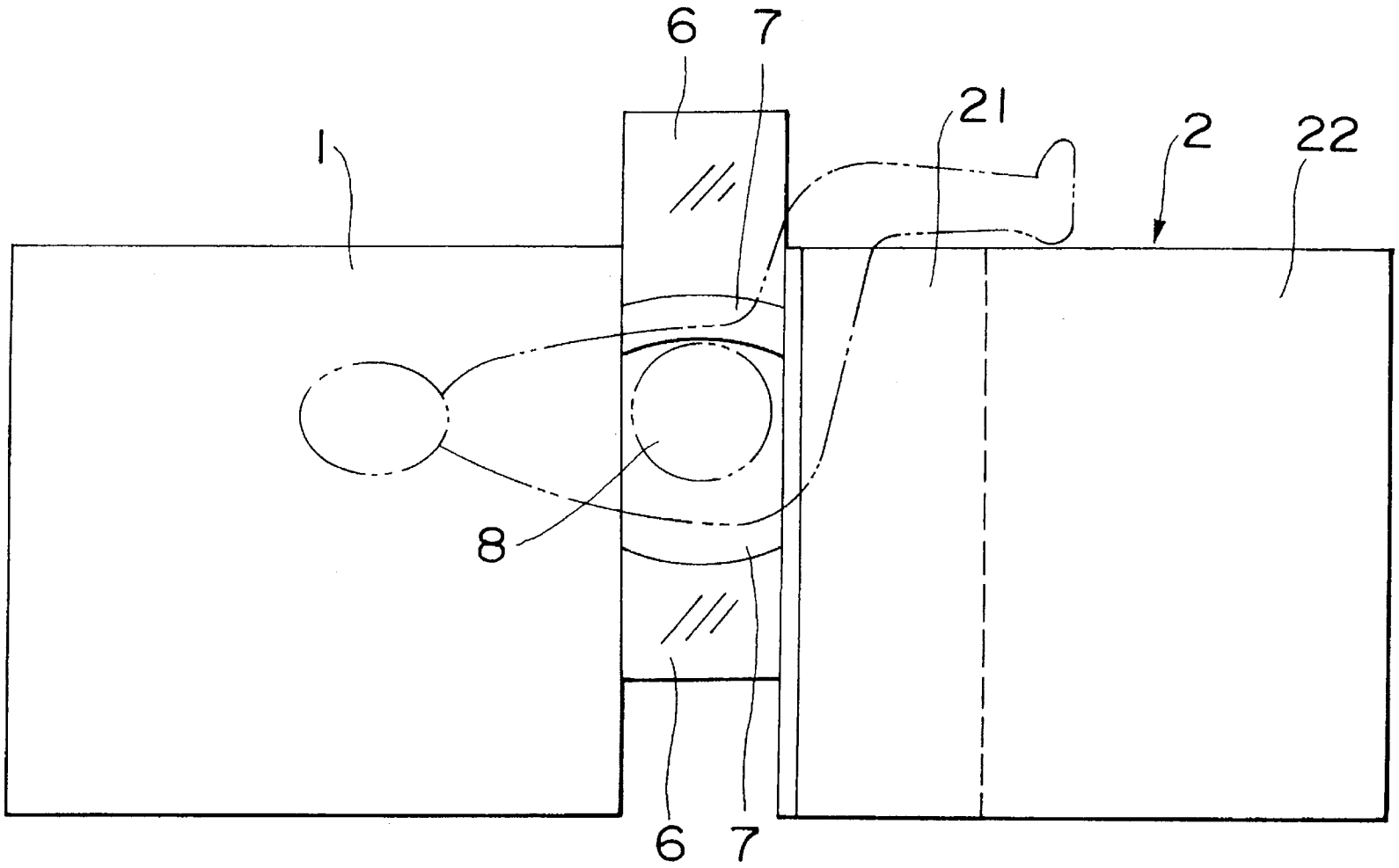
FIG. 5 is a further plan view of the bed system of the first embodiment positioned for use during excretion.

In this embodiment, as shown in FIG. 5, the pot seat 7 and the cover 6 are provided so as to be integrally movable toward either the right or left side of the bed. This allows for positional correction when the patient excretes while seated on one side of the bed.

Also, a stopper 23 capable of being expanded in the direction of the rear base 2 is provided in the vicinity of the rear peripheral portion of the front base 1. During excretion, the stopper 23 projects and is engaged with the lower end (front peripheral portion in FIG. 2) of the pot seat 7, to thereby prevent the pot seat 7 from dropping.

Also, there is provided a soil preventive cover 19 to be inserted between the patient's buttocks and the front base 1 for use during excretion. The soil preventive cover 19 operates in an interlocking manner with the stopper 23, to direct the patient's excretions to a chamber pot 8.

The chamber pot 8 is disposed under the front portion 21 of the rear base 2. The upper surface of the chamber pot 8 is covered with an openable cover body 24. In using the bed system, as shown in FIG. 1, the cover body 24 is pressed by the lower portion of the front portion 21 of the rear base 2, to almost enclose the space inside the chamber pot 8, thereby preventing the odor following excretion from spreading in the sickroom.

Figure 2:
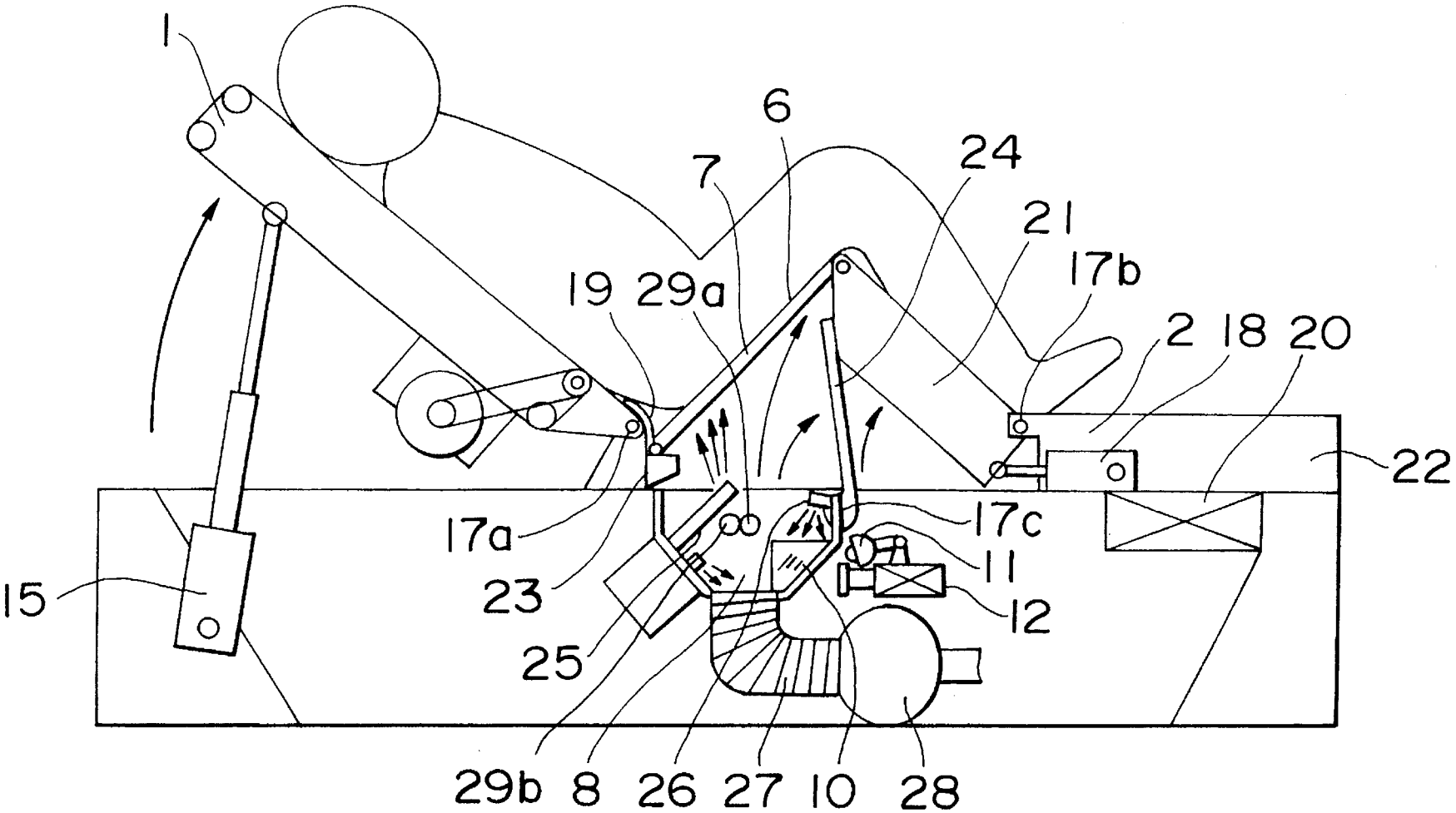
FIG. 2 is a view showing the bed system of the first embodiment positioned for using during excretion.

The cover body 24 has a spring mechanism of a balanced-lever lift type which is rotated around the supporting shaft 17*c*. It is so constructed that the leading edge thereof is opened upwardly in the excretion mode accompanied by the rise of the front portion 21 of the rear base 2 as shown in FIG. 2. In the opened state of the cover body 24, the inner surface thereof is positioned so as to face the patient's private parts, and prevent droplets such as of urine or the like from scattering within the mechanism of the bed.

A nozzle 25 serving as a dry air blowing-off port and a washing water jetting port is disposed within the chamber pot 8. The nozzle 25 is intended to wash and dry the patient's private parts following excretion. This washing and drying mechanism is conventionally known and used in public flush toilets, and a description of its operation is accordingly omitted.

A transparent window 10 through which the inside of the chamber pot 8 may be observed from an external surface thereof is provided on a part of the chamber pot 8. A TV camera illuminating device 11 and a TV camera 12 (image pick-up tube) are disposed outwardly of the transparent window 10. Optionally, the TV camera illuminating device 11 may be disposed within the chamber pot 8. An image pick-up tube using CCD is preferred as the TV camera 12 for its space utility benefits. The TV camera 12 may be directly disposed in the vicinity of the transparent window 10 or, alternatively, the light receiving end of an optical fiber may be provided in the vicinity of the transparent window 10, and the TV camera 12 may thus be disposed in a remote location.

A flush nozzle 26 is provided on the inner surface of the chamber pot 8. The pressurized water supplied from the flush nozzle 26 discharges the excretions from the chamber pot 8 through a duct 27 provided on the lower portion of the system and a drain pump 28.

Figure 3:
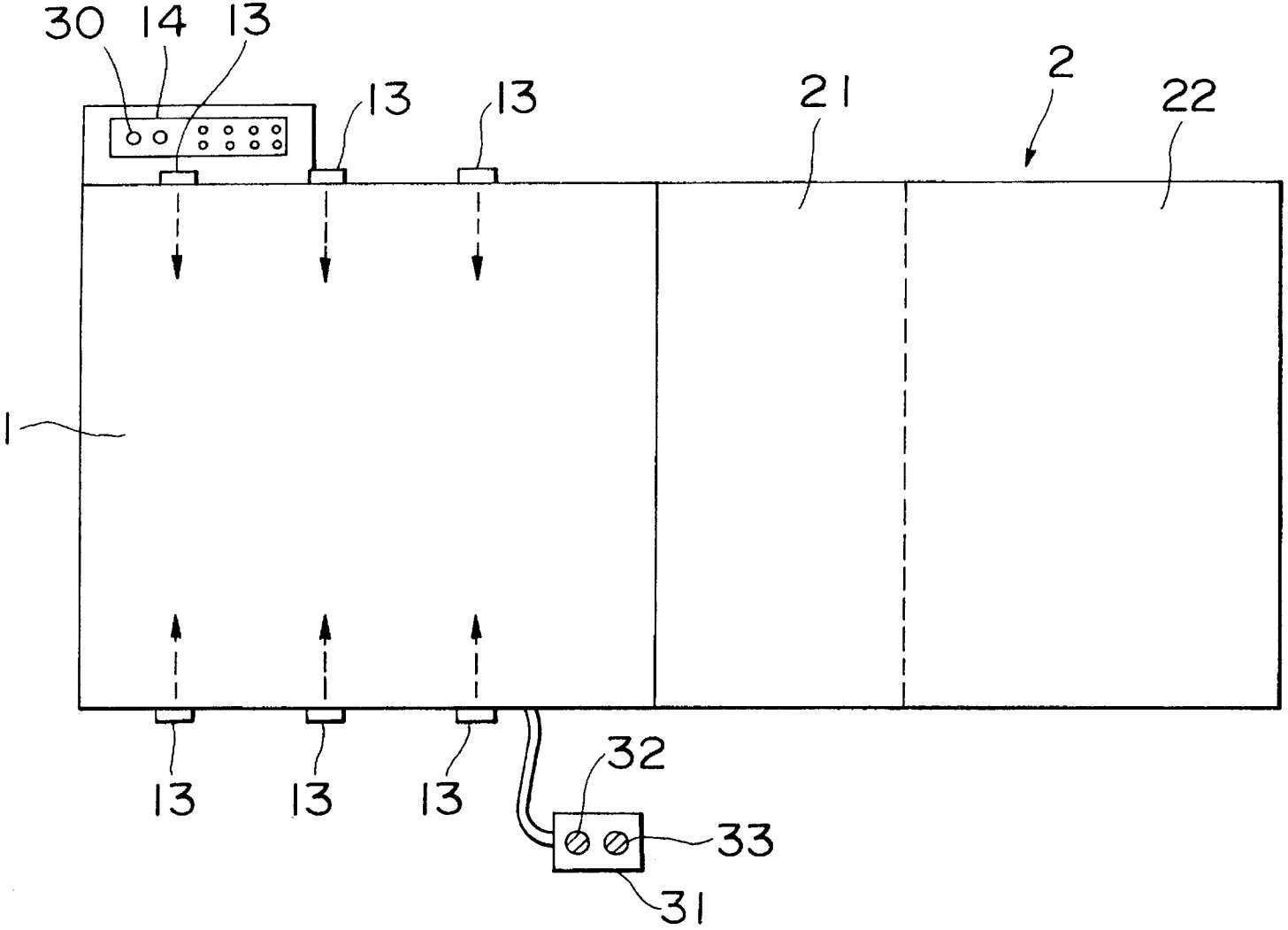
FIG. 3 is a plan view of the bed system of the first embodiment.

FIG. 3 is a schematic plan view of the bed system of this embodiment. As shown in FIG. 3, position detecting sensors 13 each having an infrared ray sensor, ultrasonic sensor or the like are disposed on both the right and left sides of the front base 1. The position of the patient on the front base 1 may be detected by the position detecting sensors 13. In addition, to detect the position of the patient, a plurality of pressure sensitive sensors may be provided on the surfaces of the front base 1 and the rear base 2 for measuring the weight distribution of the patient thereon, to thereby detect the position of the patient.

An operation panel 30 is provided on one side portion of the bed, operable by an attendant. A remote control 31 may be used to allow the patient himself to operate the system. This remote control 31 permits the patient to excrete using this system by operating an excretion request button 32 and an excretion end button 33.

Further, for a severely handicapped patient who experiences difficulty operating the remote control 31, the system may be operated according to a specified action of the patient's head which is measured by the position detecting sensors 13. Also, the system may be operated by a method wherein a patient blows a specified number of breaths in a tube communicated to a pneumatic switch sensitive to the pneumatic pressure.

Figure 6:
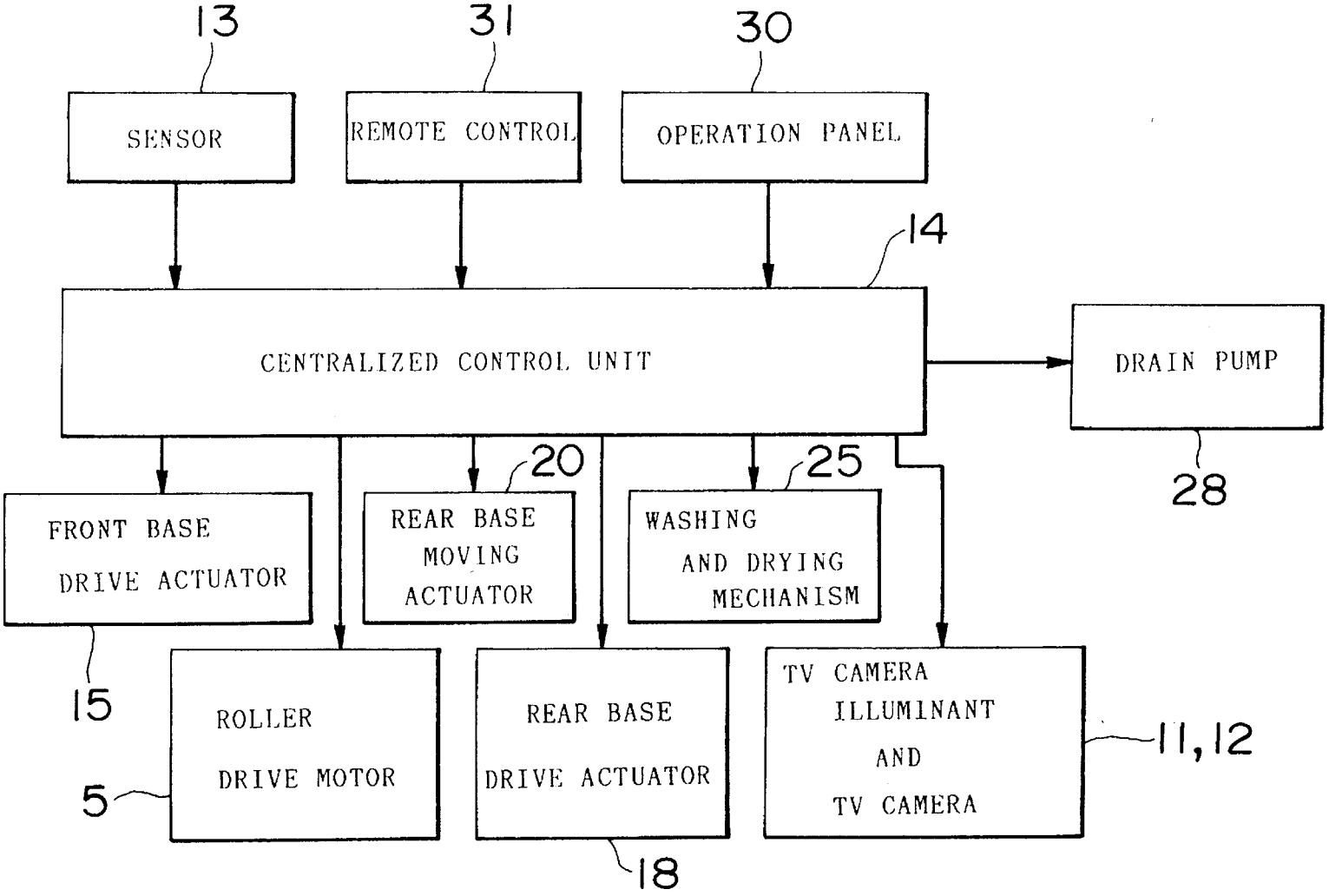
FIG. 6 is a block diagram showing the control system of the first embodiment.

Next, there will be described a control system of this embodiment, namely, a centralized control unit 14 on the lower portion of the operation panel 30. The centralized control unit 14 comprises a computer system including a memory storing control parameters and the like, a CPU, a bus for connecting them to each other, an I/O and the like (not shown). As shown in FIG. 6, the centralized control unit 14 has a function of analyzing and arithmetically operating signals supplied from the position detecting sensors 13, the remote control 31 and the operation panel 30 for operating and controlling the actuators, motors and the like.

Figure 7:
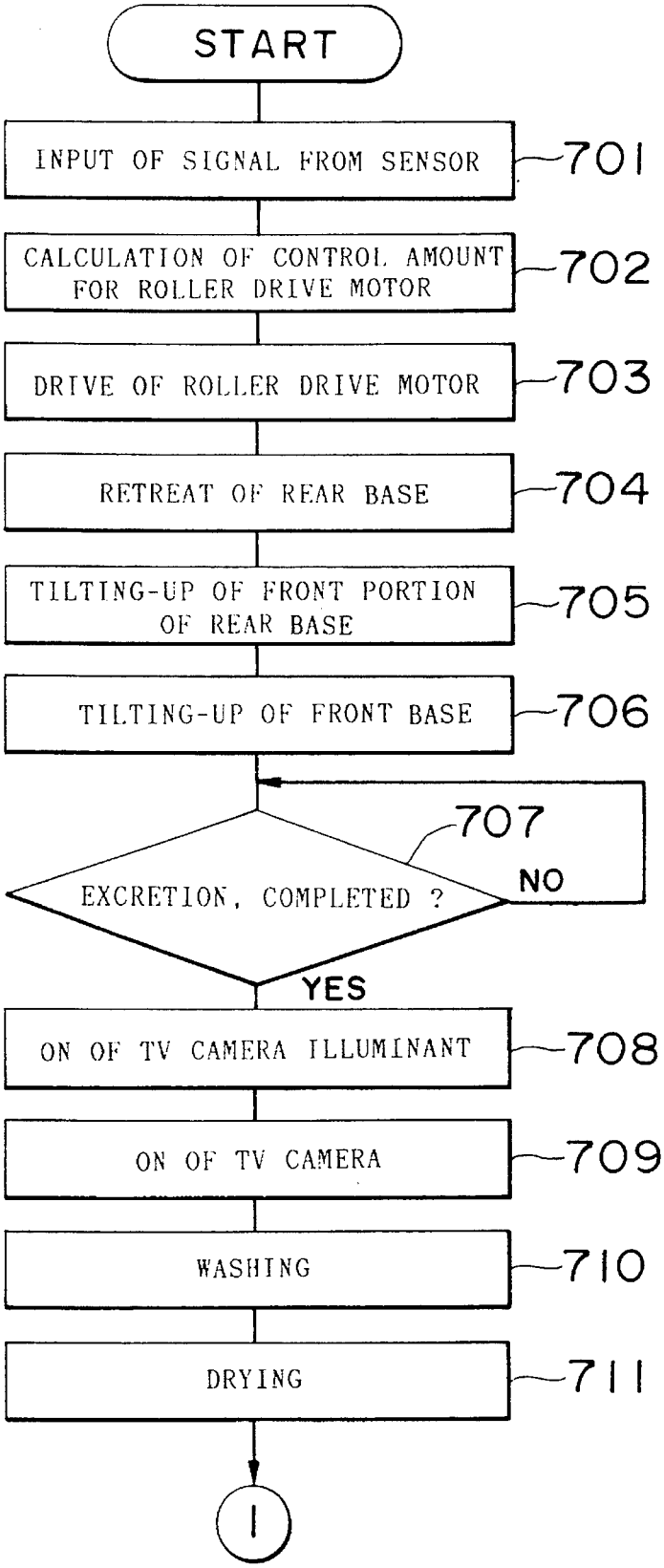
FIG. 7 is a flow chart showing the control procedure in a centralized control unit of the first embodiment.
Figure 8:
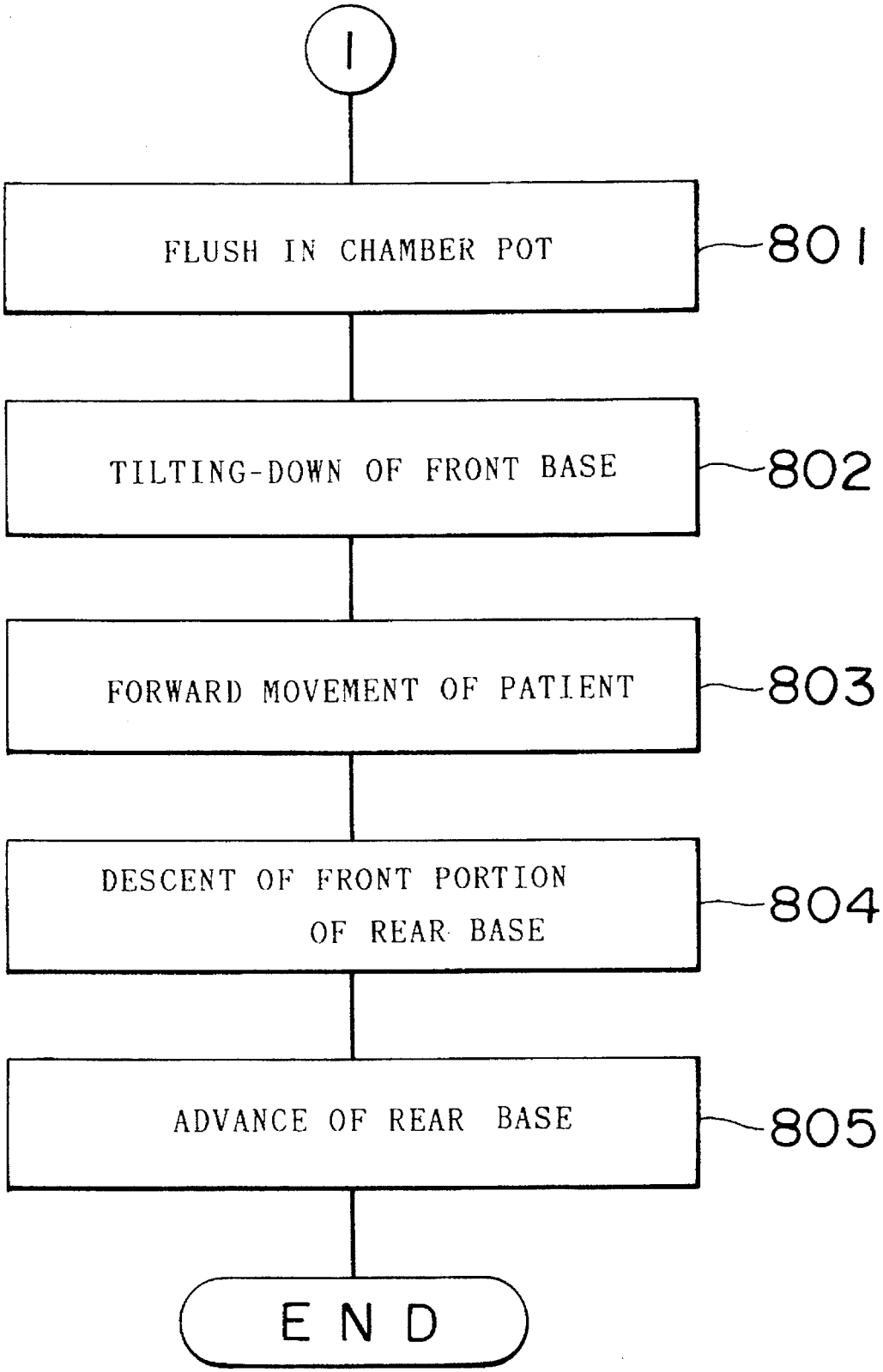
FIG. 8 is a flow chart showing a continuation of FIG. 7.

There will now be described a control procedure for the above centralized control unit 14 with reference to FIG. 7.

First, when the excretion request button 32 of the remote control 31 is pushed, detection signals are sequentially inputted from the position detecting sensors 13 to the centralized control unit 14 (step 701). The centralized control unit 14 analyzes and arithmetically operates each detection signal and calculates the correction amount for the position of the patient on the bed. The correction amount is converted into a control amount for the roller drive motor 5 (step 702).

On the basis of the control amount, the centralized control unit 14 outputs a drive signal to the roller drive motor 5, to drive the roller drive motor 5 by a specified amount (step 703). As a consequence, the patient lying upwardly of the suitable position is moved backward together with the bed sheet 4 by a specified amount. Also, the patient lying downwardly of the suitable position is moved forward together with the bed sheet 4 by a specified amount. In addition, depending on the height and the sitting height of the patient, and the request of the patient himself, the suitable position may be changeably set.

Next, the centralized control unit 14 drives the rear base moving motor 20 to retract the rear base 2 by a specified amount (step 704), and then drives the rear base drive actuator 18 to raise or tilt up the front portion 21 of the rear base 2 as shown in FIG. 2 (step 705). At this time, in this embodiment, the pot seat 7 is raised in such a manner as to interlock with the front portion 21 of the rear base 2, and is inserted under the patient's buttocks. Since the patient's position is previously corrected by the posture regulating mechanism described above, the patient's buttocks are accurately positioned with respect to the pot seat 7. Also, at the same time, the soil preventive cover 19 is raised and is set between the rear peripheral portion of the front base 1 and the patient's buttocks.

Next, the centralized control unit 14 outputs an operational signal to the front base drive actuator 15, to raise or tilt up the front base 1 as shown in FIG. 2 (step 706). When excretion is completed in this state and the patient pushes the excretion end button 33 of the remote control 31 (step 707), the TV camera illuminating device 11 is lit up (step 708), and the TV camera 12 is operated (step 709) to pick up an image of the excretions within the chamber pot 8. The image thus picked up is observed by an external TV monitor or the like (not shown), so that the health of the patient, for example, the digestive power of his internal organs may be determined.

Also, the TV camera 12 may be replaced by an infrared ray temperature detecting camera for detecting the temperature distribution of the excretions.

Also, for a detailed inspection, there may be provided an opening/closing door on a part of the window portion or a receiving portion for directly sampling the excretions.

After completion of the above inspection, by the command of the centralized control unit 14, the patient's private parts are washed by hot water jetted from the washing nozzle 25, and then dried by hot air supplied from the air duct 29*a* (step 711)

Here, the hot air thus supplied is discharged from the air duct 29*b* to the outside by an exhauster (not shown). In addition, the air discharged from the air duct 29*b* may be discharged from an exhaust tube or drain tube to the outside, or may be circulated to the interior through a deodorizing device.

Further, pressurized water is released from the flush nozzle 26 to the inside of the chamber pot 8, and drain pump 28 is operated to flush the inside of the chamber pot 8 (step 801).

Next, the front base drive actuator 15 is controlled to return the front base 1 to the original horizontal state (step 802), and the roller drive motor 5 is controlled to move the patient forward (step 803). Namely, the upper half of the patient which was moved downward (backward) in excretion is returned to the forward position, thus insuring that the patient's buttocks are not pinched between the front base 1 and the rear base 2 during advancement of the rear base 2.

Next, the rear base drive actuator 18 is controlled to lower the front portion 21 of the rear base 2 (step 804), and the rear base moving motor 20 is controlled to advance the rear base 2 (step 805), thereby returning the rear base 2 to the original horizontal state as shown in FIG. 1.

In addition, by the lowering and advancement of the front portion 21 of the rear base 2, the cover body 24 of the chamber pot 8 is perfectly closed, and consequently the odor following excretion remains in the chamber pot 8 and is prevented from spreading in the sickroom.

Also, it is possible to flush the inside of the chamber pot 8 after closing the cover body 24. At this time, prior to flushing with the water supply from the flush nozzle 26, the rear surface of the cover body 24 may be washed by water jetted from the washing nozzle 25.

Embodiment 2

A second embodiment of the present invention will be described with reference to FIGS. 9 through 17.

In these figures, parts corresponding to those in Embodiment 1 are designated by the same numerals, and the explanation is thus omitted.

Figure 9:
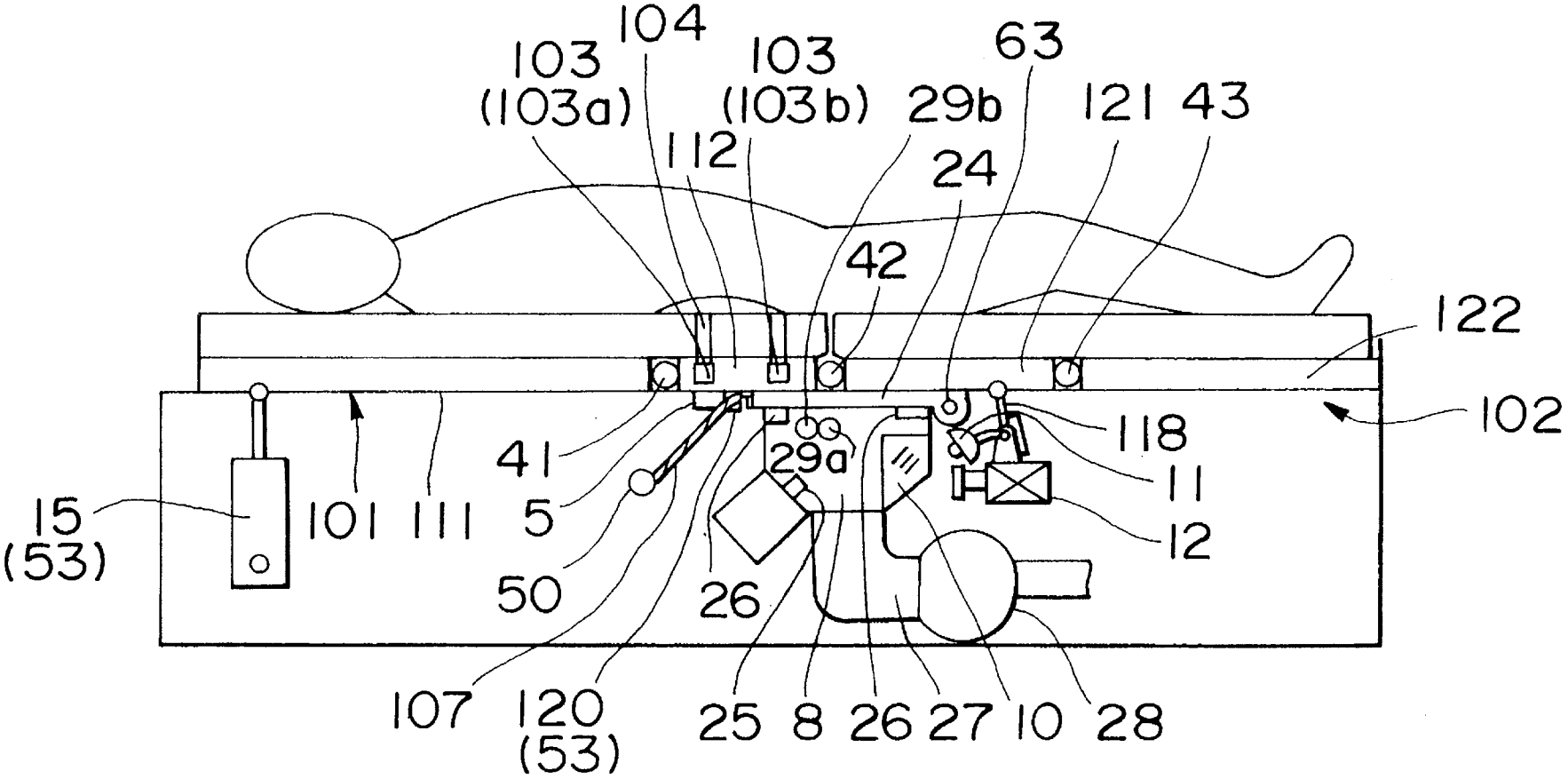
FIG. 9 is a schematic structural view of a bed system according to a second embodiment of the present invention showing the bed in the non-excreting position.

FIG. 9 is a schematic view showing the mechanism of a bed system of the second embodiment. The upper surface of the bed is comprised of a front base 101 and a rear base 102.

First, the peripheral construction of the front base will be described.

The front base 101 is comprised of a first front portion capable of being tilted up by the front base drive actuator 15 (front base drive means 53), and a first rear portion 112 capable of being moved forward and backward by a front base moving motor 120 (front base drive means 53).

The first front portion 111 and the first rear portion of the front base 101 are connected with each other by a supporting shaft 41, and are integrally moved forward and backward. Also, the first front portion 111 can be tilted up around the supporting shaft 41 as a fulcrum by means of a base drive actuator 15 using a cam mechanism, hydro-power or the like, independently from the first rear portion 112.

Figure 12:
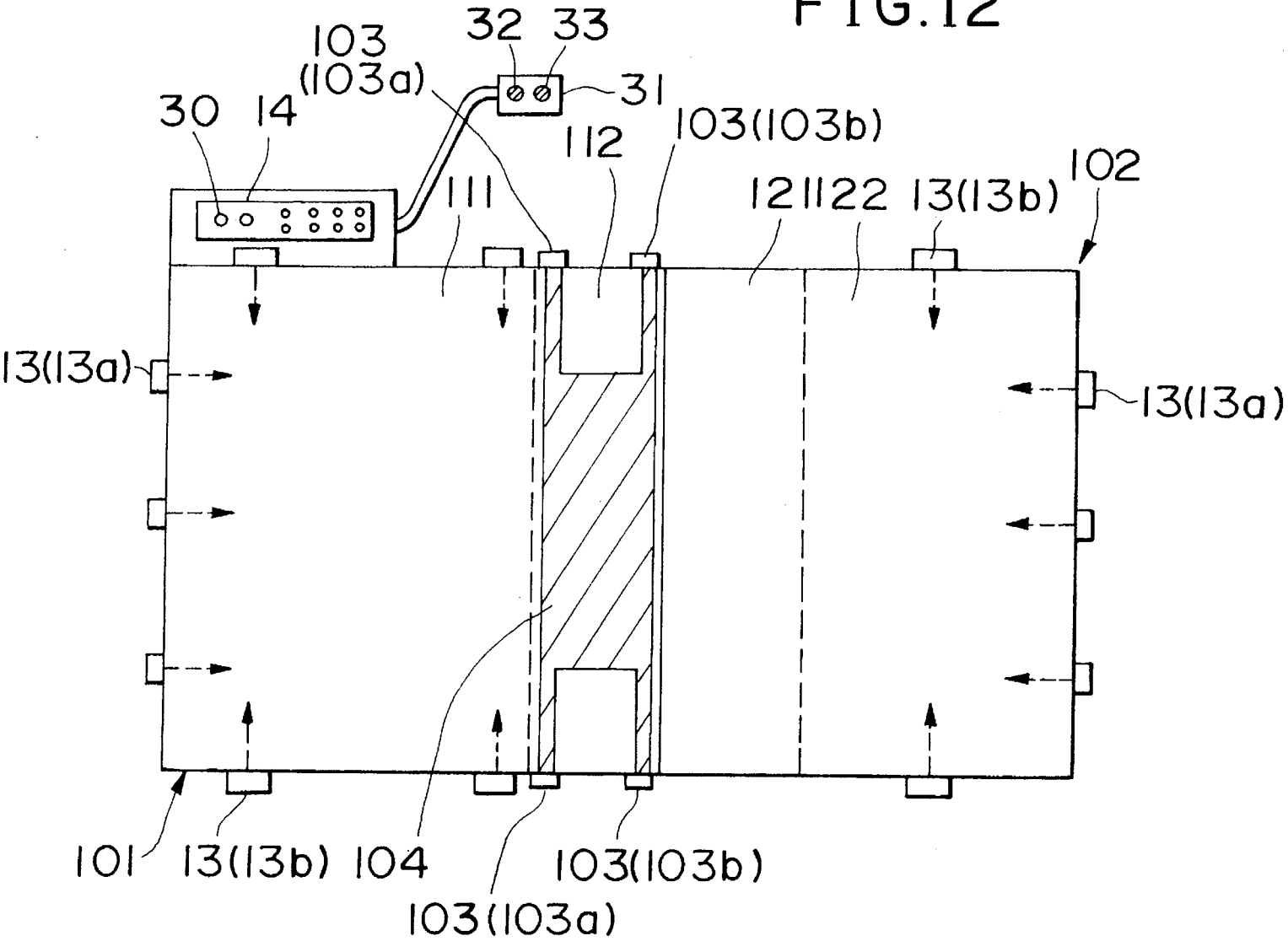
FIG. 12 is a plan view of the bed system of the second embodiment.

Rollers 103 (103*a*, 103*b*) and rollers 103 (103*a*, 103*b*) are disposed on the right and left sides of the first rear portion 112 of the front base 101, respectively. The rollers 103 and 103 are rotated by a roller drive motor 5 as a roller drive means. A sheet 104 is stretched between the rollers 103*a* and 103*b* on one side and the rollers 103*a* and 103*b* on the other side. By rotation of the rollers 103 and 103 by the roller drive motor 5, the above sheet 104 may be moved rightward and leftward. Namely, by rotation of the rollers 103 and 103, the sheet 104 is operated so as to ba fed or rolled in. As shown in FIG. 12, the sheet 104 may be narrow in width to the extent of being spread under the waist of a patient lying on the bed.

Also, the first front portion 111 of the front base 101 can be tilted downwardly of the horizontal position around the supporting shaft 41 as a fulcrum by means of the front base drive actuator 15. Accordingly, where the patient's body is shifted on the rear base 102 side, by tilting down of the first front portion 111, the position of the body can be easily returned to the front base 101 side.

The reason why the sheet 104 is provided only on the first rear portion 112 in this embodiment is as follows: namely, since gravity or the bulk of the weight of the patient's body lying in the bed is positioned slightly above the buttocks, it is possible to move the patient, that is, regulate the patient's posture by moving the sheet 104 of the first rear portion 112 on which the patient's waist corresponding to the bulk of his weight lies.

In addition, the sheet 104 and the drive means therefor may be provided not only on the first rear portion 112 but also on the first front portion 111 or a second front portion 121 described later.

Next, there will be described the peripheral construction of the rear base 102.

The rear base 102 is comprised of a second front portion 121 capable of being tilted up by a rear base drive actuator 118 (rear base drive means), and a second rear portion 122 capable of being separated from a bed main body 100 by tilting up of the second front portion 121. The second front portion 121 and the second rear portion 122 of the rear base 102 are connected with each other by a supporting shaft 43, and are integrally moved forward and backward. Also, a supporting shaft 42 is provided on the front peripheral portion of the second front portion 121.

The second front portion 121 can be tilted up and tilted down around the supporting shaft 43 as a fulcrum by means of the rear base drive actuator 118, independently of the second rear portion 122. Also, the second front portion 121 and the second rear portion 122 may be integrally tilted up and tilted down around the supporting shaft 42 as a fulcrum.

Figure 14:
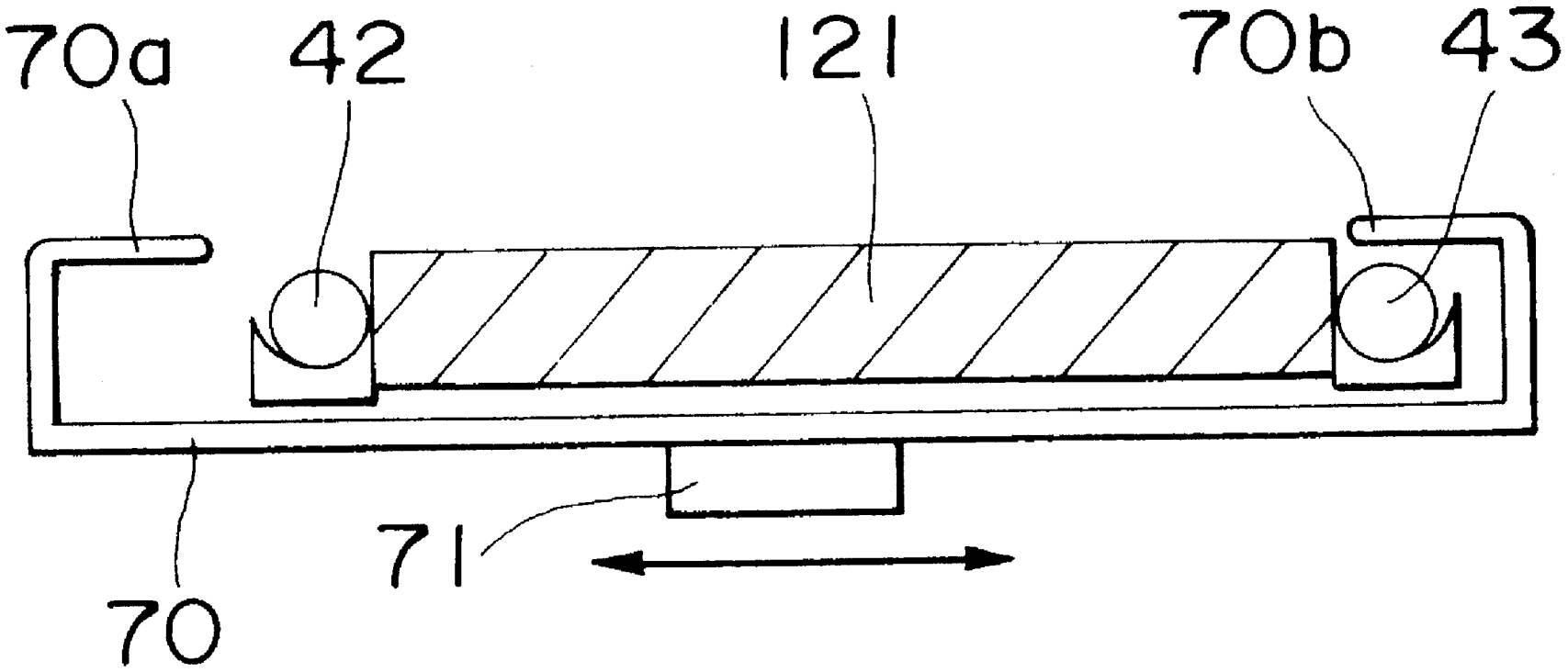
FIG. 14 is a view showing the relationship between supporting shafts and a supporting device at a second front portion of the second embodiment.

As shown in FIG. 14, a supporting device 70 is provided in the vicinity of the supporting shafts 42 and 43. Internally bent claws 70*a* and 70*b* are provided on both ends of the supporting device 70, respectively. By movement of the supporting device 70 forward and backward, the supporting shaft separable from the bed main body 100 may be selected.

Namely, when the supporting device 70 is positioned on the front side, the supporting shaft 43 is fixed by the claw 70*b*, so that the front end side of the second front portion 121 may be freely tilted up. On the other hand, when the supporting device 70 is positioned on the rear side, the supporting shaft 42 is fixed by the claw 70*a*, so that the rear end side of the second front portion 121 maybe freely tilted up. In addition, the supporting device 70 is formed so as to freely move forward and backward by a supporting device moving motor 71.

Figure 11:
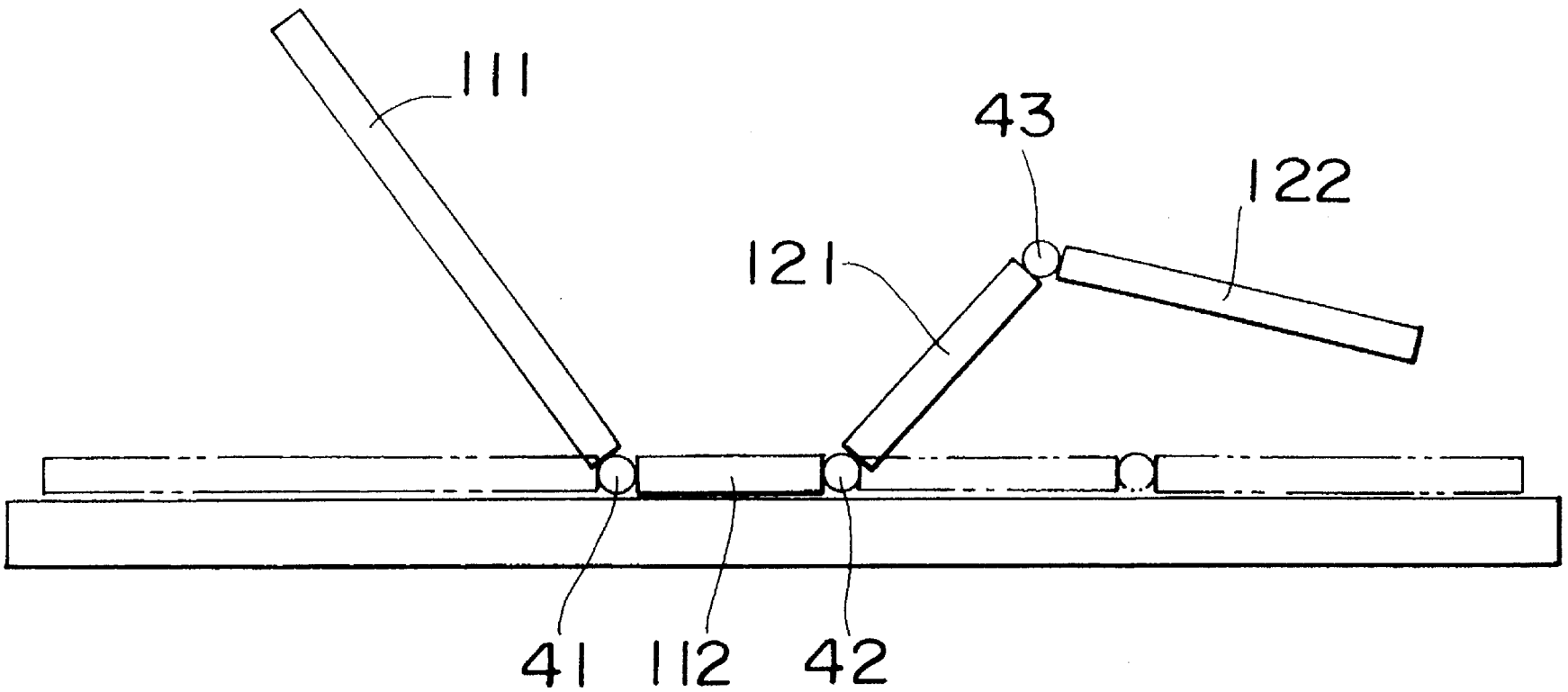
FIG. 11 is a schematic view showing an alternate form of the bed of the second embodiment in the non-excreting position.

In the case where the supporting shaft 42 is fixed, when the rear end side of the second front portion 121 is tilted up as shown in FIG. 11, the second rear portion 122 is raised in such a manner as to interlock with the second front portion 121. Here, an actuator for directly supporting the second rear portion 122 may be provided so as to stably perform the tilting up of the rear base 102 around the supporting shaft 42 as a fulcrum.

Figure 13:
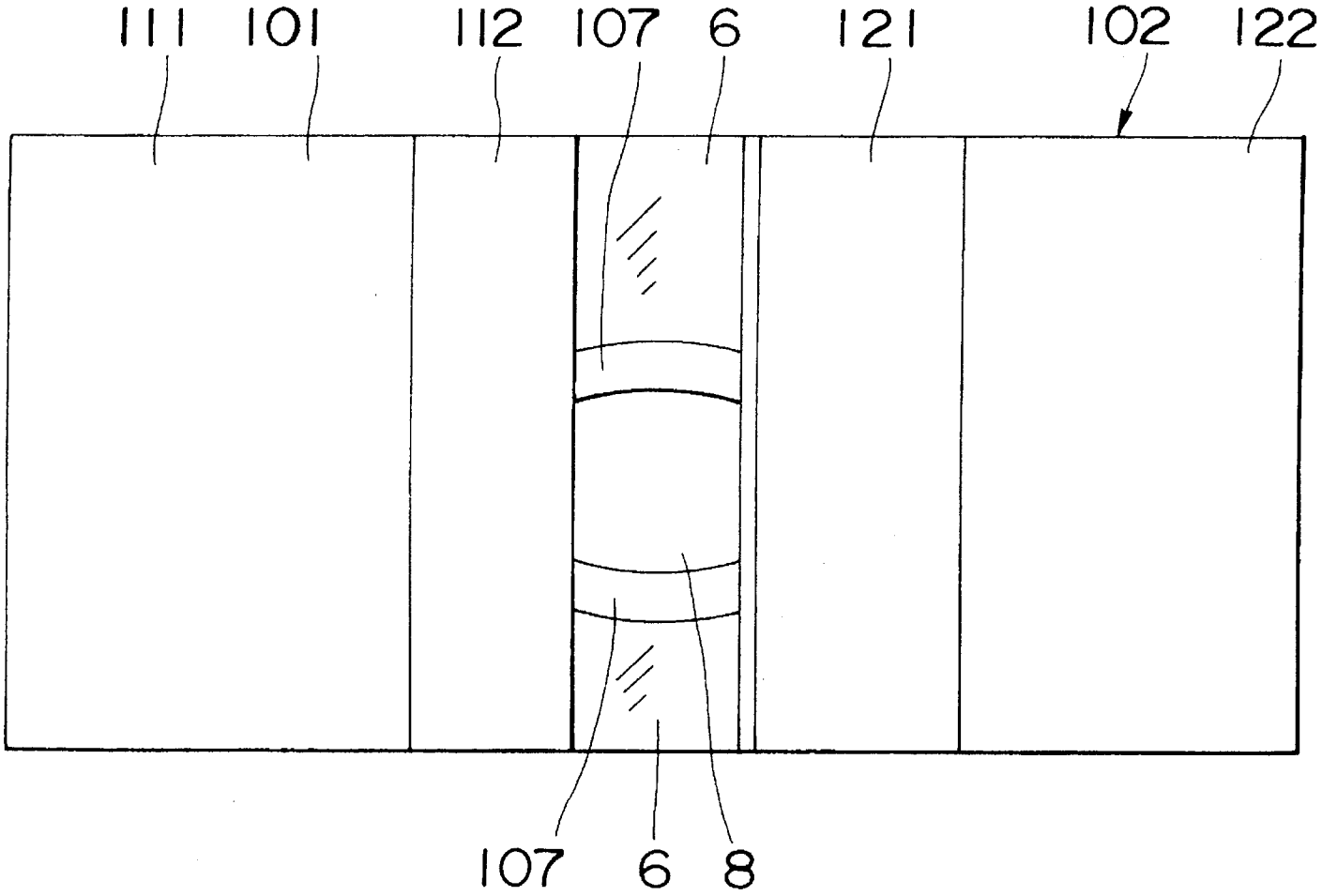
FIG. 13 is a plan view of the bed system of the second embodiment positioned for use during excretion.

A sheet-like pot seat 107 having an opening shape as shown in FIG. 13 is provided on the front peripheral portion of the rear base 102 so as to be substantially perpendicular to the rear base 102. The pot seat 107 maybe rolled by a roller 50, and is expanded in accompaniment with the tilting up of the second front portion 121. In addition, the pot seat 107 is not limited to the sheet shape capable of being rolled but may be formed of a slightly flexible board, made of a synthetic resin. In this case, a slit for retractably containing this board may be formed at the portion of the roller 50.

Also, a stopper 23 capable of being expanded in the direction of the rear base 102 is provided in the vicinity of the rear peripheral portion of the front base 101. In excretion, the stopper 23 projects and is engaged with the lower end of the pot seat 107 (front peripheral portion in FIG. 2), to thereby keep the flexibility of the pot seat 107 within a specified value.

A chamber pot 8 is provided under the second front portion 121 of the above rear base 102.

FIG. 12 is a schematic plan view of the bed system according to this embodiment. As shown in FIG. 12, position detecting sensors 13*a* and 13*b* are provided on the front end portion and the side end portion of the front base 101, and the rear end portion and the side end portion of the rear base 102, respectively.

In addition, in this embodiment, a mat is provided on the upper portions of the front base 101 and the rear base 102, and is covered with a bed sheet; however, the surface of the base itself may serve as the mat.

Figure 15:
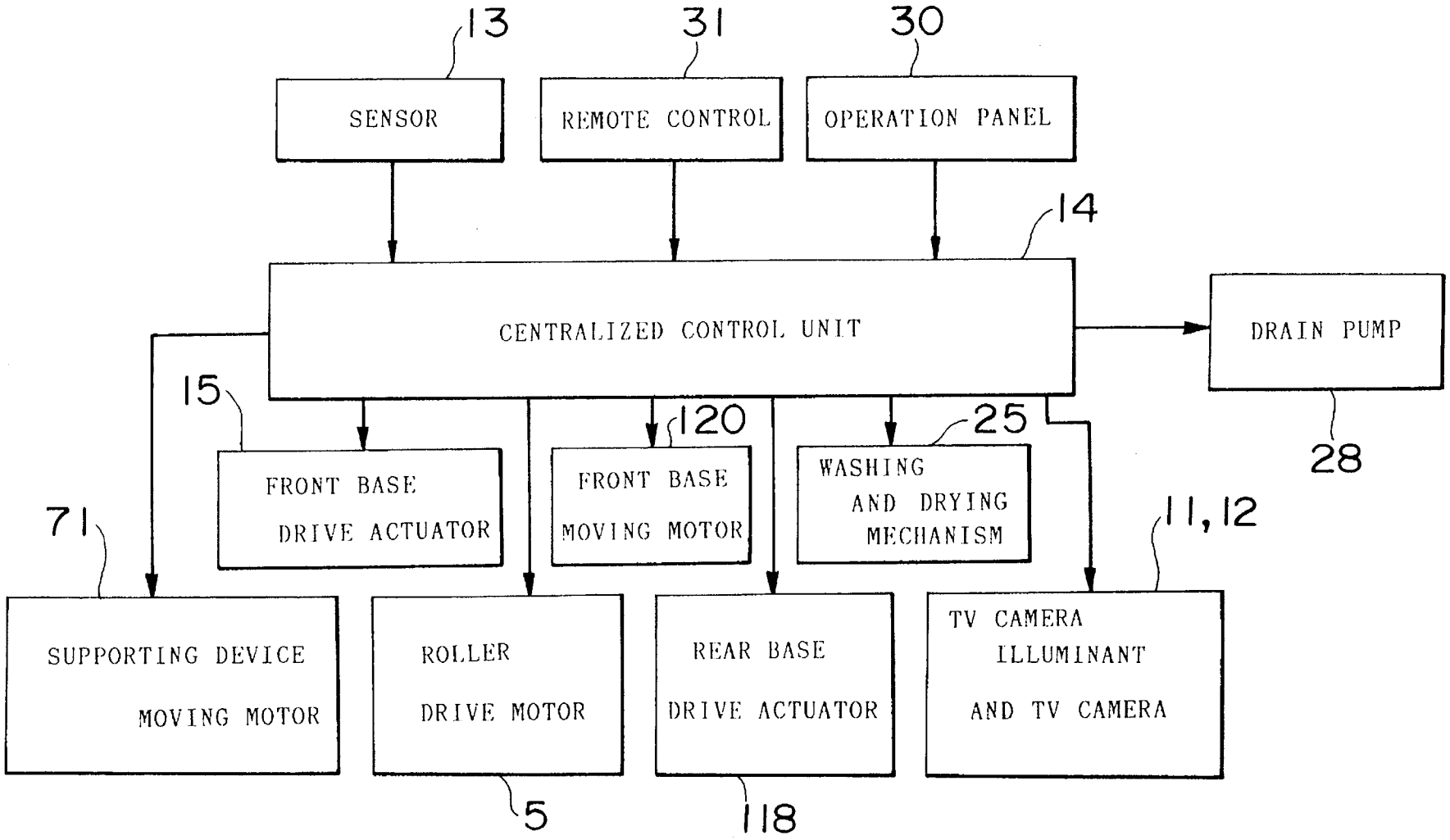
FIG. 15 is a block diagram showing the control system of the second embodiment.

As shown in FIG. 15, just as in Embodiment 1, a centralized control unit 14 used in this embodiment has a function of analyzing and arithmetically operating each signal for operating and controlling each actuator, each motor and the like.

Figure 16:
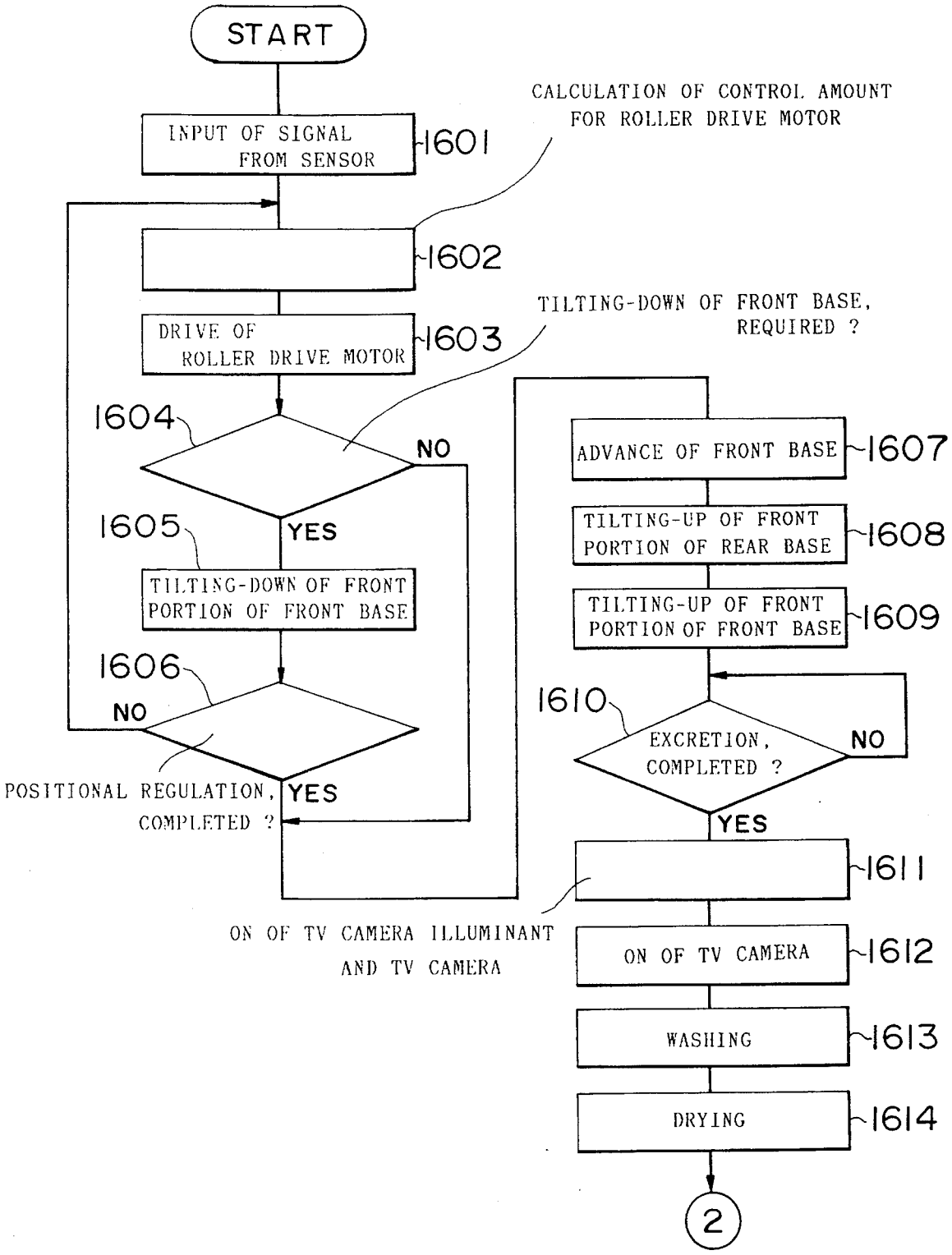
FIG. 16 is a flow chart showing the control procedure in the centralized control unit of the second embodiment.
Figure 17:
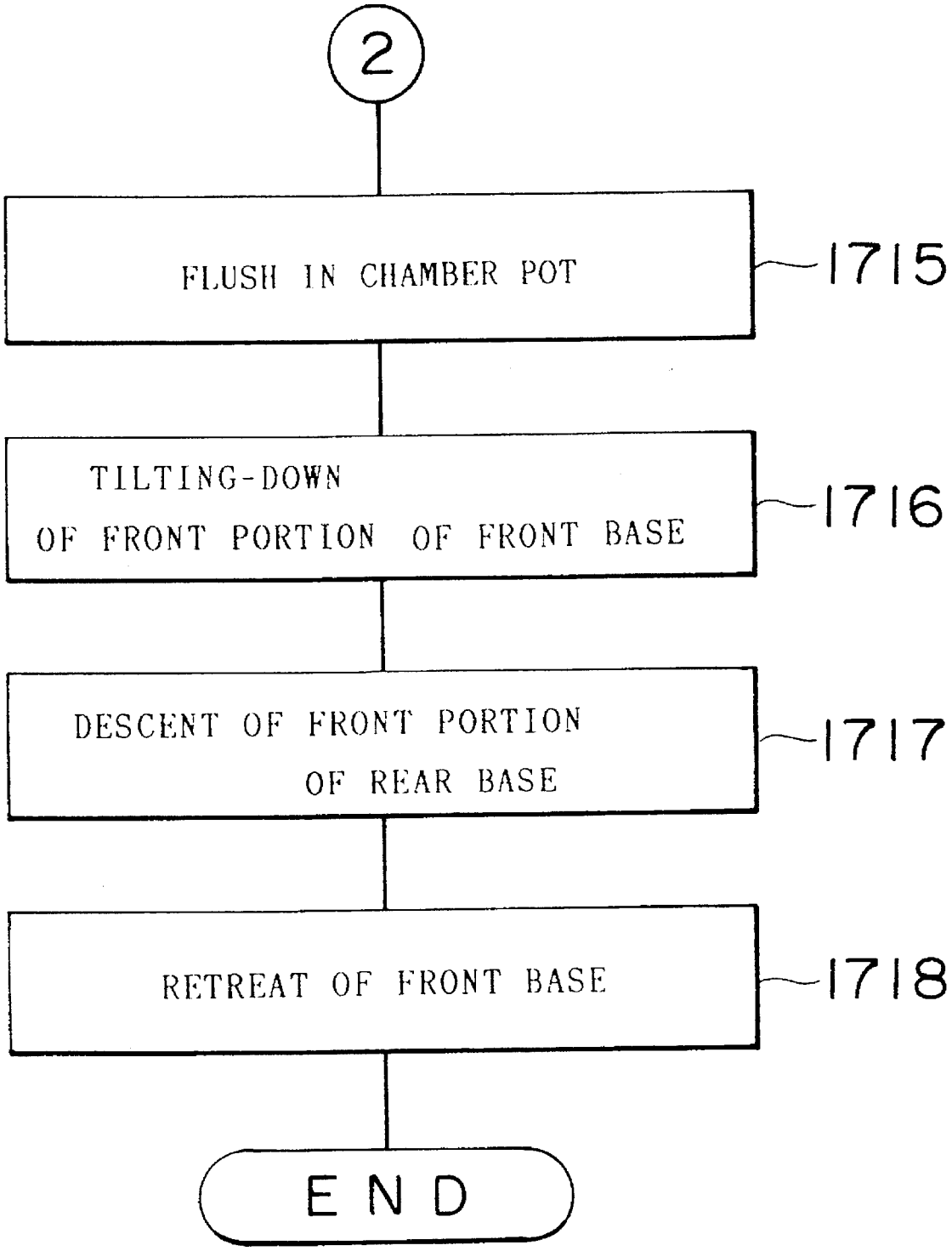
FIG. 17 is a flow chart showing a continuation of FIG. 16.

Next, the control procedure of the centralized control unit 14 will be described with reference to FIGS. 16 and 17.

First, when an excretion request button 32 of a remote control 31 is pushed, the detection signals are sequentially inputted from the position detecting sensors 13*a* and 13*b* to the centralized control unit 14 (step 1601). The centralized control unit 14 analyzes and arithmetically operates each detection signal and calculates the correction amount for the position of a patient lying on the bed. The correction amount (for right and left position) is converted into the control amount for a roller drive motor 5 (step 1602).

On the basis of the control amount, the centralized control unit 14 outputs a drive signal with respect to the roller drive motor 5 to drive it by a specified amount (step 1603). As a consequence, the patient positioned to the left of a suitable position is moved to the right together with the sheet 104. Also, the patient positioned to the right of a suitable position is moved to the left by a specified amount together with the sheet 104.

Next, the centralized control unit 14 judges whether or not the patient must be corrected in his position forward and backward (step 1604). In this step 1604, where the patient is positioned on the rear side, it is determined that the tilting down of the front base is required. If the patient is positioned on the front side, in a step 1609 described later, the positional regulation may be made when the first front portion 111 of the front base 101 is tilted up. Namely, in the case where the patient is positioned on the rear side, the first front portion 111 of the front base 101 is tilted downwardlY from the horizontal position, in order to regulate the patient's position (step 1605). Also, where the patient is positioned at the suitable position forward and backward, or positioned only on the front side, the process advances to a step 1607.

The centralized control unit 14 determines whether or not the positional regulation of the patient is completed (step 1606). Where the patient lies to the right or left of the suitable position, the process returns to step 1602. At step 1606, when the patient is positioned at the suitable position or positioned only on the front side, the process advances to the step 1607.

Figure 10:
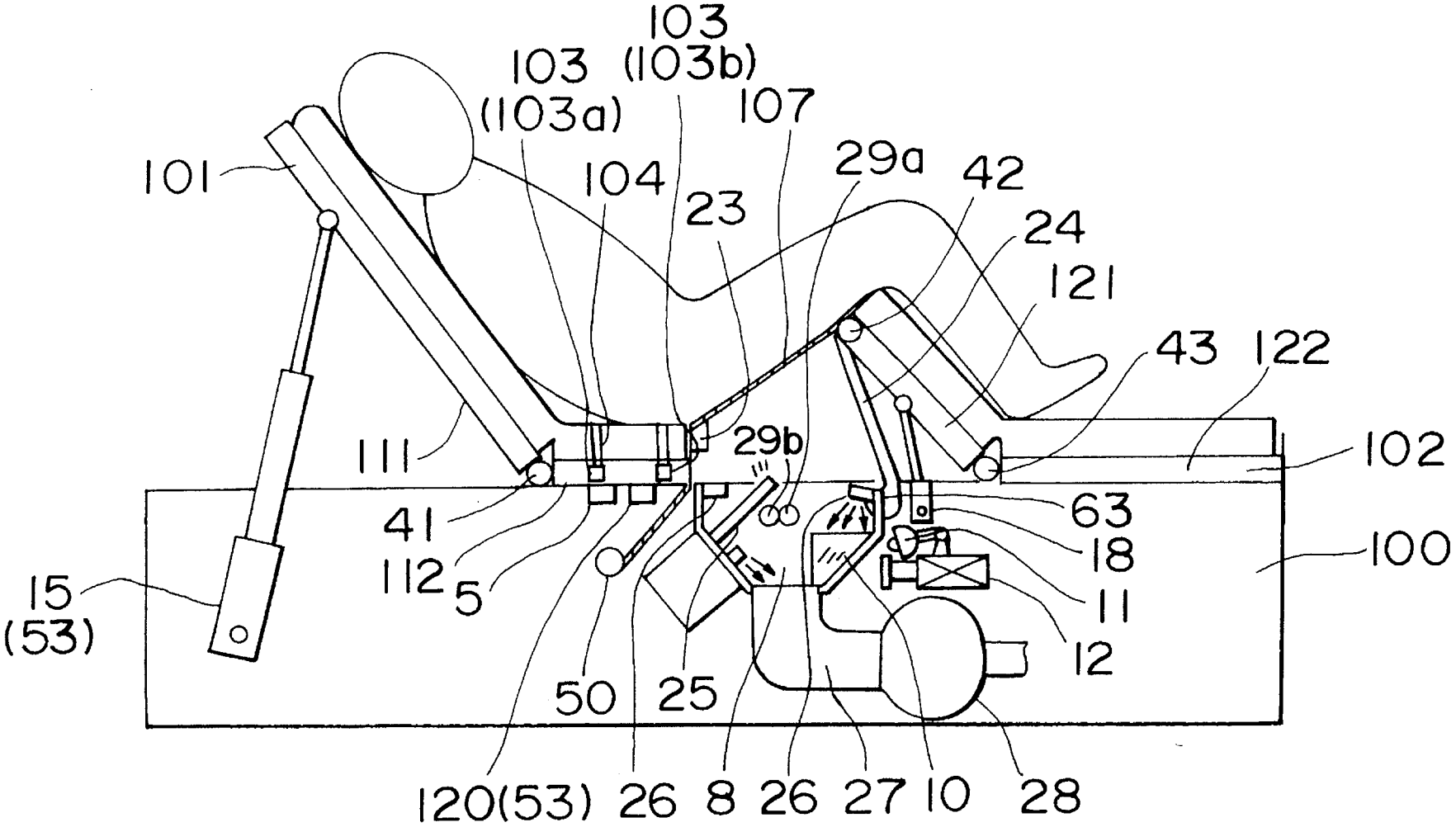
FIG. 10 is a schematic structural view of the bed system according to the second embodiment of the present invention showing the position of the bed during excretion.

The centralized control unit 14 drives the front base moving motor 120 to advance the front base 101 by a specified amount (step 1607). After that, it drives the rear base drive actuator 118 to raise or tilt up the second front portion 121 of the rear base 102 as shown in FIG. 10 (step 1608). At this time, in this embodiment, a pot seat 107 is tilted up in such a manner as to interlock with the second front portion 121 of the rear base 102, and is inserted under the patient's buttocks.

Next, the centralized control unit 14 outputs an operational signal with respect to the front base drive actuator 15 to raise or tilt up the first front portion 111 of the front base 101 as shown in FIG. 10 (step 1609). At this time, since the patient's position was previously corrected by the posture regulating mechanism as described above, the buttocks are accurately positioned with respect to the pot seat 107. Also, in the case where the patient is positioned on the front side, the upper half of the patient's body is gradually moved down accompanied by the tilting up of the front base 101, so that the patient's buttocks are accurately positioned on the pot seat 107.

When excretion is completed in this state and the patient pushes an excretion end button 33 of a remote control 31 (step 1610), a TV camera illuminating device 11 is lit up (step 1611), and a TV camera 12 is operated (step 1612) for picking up an image of excretions within the chamber pot 8. The image thus picked up is observed by an external TV monitor or the like (not shown), so that the health of the patient, for example, the digestive power of his internal organs may be determined.

After completion of the above inspection, by the command of the centralized control unit 14, the patient's private parts are washed by hot water jetted from a washing nozzle 25, and then dried by hot air supplied from an air duct 29*a* (steps 1613 and 1614).

Further, pressurized water is released from a flush nozzle 26 to the inside of the chamber pot 8 and a drain pump 28 is operated, to thereby flush the inside of the chamber pot 8 (step 1715).

Next, the front drive actuator 15 is controlled to return the front base 101 to the original horizontal state (step 1716) and the rear base drive actuator 118 is controlled to lower the second front portion 121 of the rear base 102 (step 1717). The front base moving motor 120 is controlled to move the front base 101 backward, thus returning the bed to the original horizontal state as shown in FIG. 9.

According to this embodiment, the front base is divided into a front portion and a rear portion, and the rear base is divided into a front portion and a rear portion. Accordingly, in excretion, it is possible to keep the rear portion of the front base in the horizontal position, and hence to stabilize the posture of the patient during excretion. Also, since the buttocks do not slip down in the opening portion of the chamber pot, the patient is not pinched between the front base and the rear base following excretion.

According to this embodiment, in positional correction to the rear side, the first front portion 111 of the front base 101 is tilted down from the horizontal position. However, the second front portion 121 and the second rear portion 122 of the rear base 102 may be tilted up and raised around the supporting shaft 42 of the second front portion 121 as a fulcrum, so that the patient may be moved forward easily.

Also, the front base 101 may be tilted up and tilted down around the rear end of the front base 101 as a fulcrum without the tilting up and tilting down only of the first front portion 111. In this case, where the front base 101 is tilted up or tilted down around the rear end of the rear portion 112 as a fulcrum, the relative angle between the first front portion 111 and the first rear portion 112 is variable around the supporting shaft 41.

As described above, according to the present invention, it is possible to regulate a patient's posture to permit the patient to excrete comfortably. Also, it is possible to automate the operation in excretion, and hence to reduce the labor of the patient and the attendant.

What is claimed is:

1. A bed system with an excreting mechanism for use by a patient and operable with a bed sheet comprising:

a front base for receiving the upper half of a patient's body, said front base having front and rear peripheral portions and side portions and capable of having its front portion tilted upward being tilted up;

a rear base for receiving the lower half of said patient's body, said rear base having a front peripheral portion and being movable forward and backward and having a front portion capable of being tilted up;

a posture regulating mechanism comprising at least a pair of rollers provided in said front peripheral portion of said front base and said rear peripheral portion of said front base, respectively; said bed sheet being stretched between said rollers and capable of being moved forward and backward by rotation of said rollers;

a roller drive means for driving said rollers;

a pot seat provided at an opening portion between said rear peripheral portion of said front base and said front peripheral portion of said rear base when said front base is tilted up and said rear base is moved backward and said front portion of said rear base is tilted upward; and a chamber pot disposed under said pot seat in such a manner that the upper surface thereof is opened and closed when said front portion of said rear base is tilted up or down respectively.

2. A bed system with an excreting mechanism according to claim 1, wherein said pot seat includes a cover at both ends thereof, said pot seat being movable to the right and left side integrally with said cover.

3. A bed system with an excreting mechanism according to claim 1, further comprising a transparent window provided on the surface of said chamber pot for freely observing patient's excretions, an illuminating device provided outside or inside said transparent window for lighting the inside of said chamber pot and an image pick-up device for picking up an image of the inside of said chamber pot.

4. A bed system with an excreting mechanism according to claim 3, further comprising:

position detecting sensors provided in the vicinity of the peripheral portion of said front base for detecting the position of the patient;

a centralized control unit for receiving signals from said position detecting sensors;

a front base drive means for tilting up and tilting down said front base; and a rear base drive means for moving said rear base and for tilting up and tilting down said front portion of said rear base;

wherein said centralized control unit analyzes signals from said position detecting sensors, calculates the movement amount for said bed sheet, supplies said correction amount to said roller drive means as a drive signal for regulating the posture of the patient; outputs drive signals to said front base drive means and said rear base drive means for tilting up said front base, and for moving backward and tilting up said rear base; and outputs operational signals to said illuminating device and said image pick-up device for picking up an image of the inside of said chamber pot.

5. A bed system with an excreting mechanism according to claim 1, further comprising:

at least one position detecting sensor provided in the vicinity of the peripheral portion of said front base for detecting the position of a patient;

a centralized control unit for receiving signals from said position detecting sensor;

a front base drive means for tilting up and tilting down said front base; and a rear base drive means for moving said rear base, and for tilting up and tilling down said front portion of said rear base;

wherein said centralized control unit analyzes signals from said position detecting sensor, calculates the amount of movement of said bed sheet to position said patient's buttocks to overlie said pot seat, and supplies a drive signal to said roller drive means for regulating the posture of the patient and outputs drive signals to said front base drive means and said rear base drive means for tilting up said front base, and for moving backward and tilting up said rear base.

6. A bed system with an excreting mechanism according to claim 1, further comprising manual switch means for operating said roller drive means.

7. A bed system with a bed sheet movable forwardly and backwardly for regulating the posture of a bed-ridden patient and adjustable between a first horizontal configuration and a second raised configuration to permit said patient to excrete, comprising:

a frame, a front base for supporting the upper half of a patient's body, said front base having front and rear portions, a rear base for supporting the lower half of a patient's body, said rear base having front and rear portions and being movable on the frame forward and backward relative to said front base, said front and rear bases being adapted to move from a first arrangement in which said front and rear bases lie generally coplanar when said bed is in said horizontal configuration to a second arrangement in which said front portion of each of said front and rear bases pivots upwardly when said bed is in said raised configuration;

a pot seat pivotally mounted to said front portion of said rear base, said pot seat being substantially perpendicular to said rear base when said bed is in said horizontal configuration and pivoting upwardly to engage said frame near the rear portion of said front base to support said patient's buttocks in a raised position for excretion when said bed is in said raised configuration, a chamber pot having a top, the chamber pot carried by said frame and disposed under said pot seat when said pot seat is raised, said chamber pot top being exposed when said pot seat is in said raised position and being covered when said front and rear bases are returned to their horizontal configuration, and drive means for moving said front and rear bases and pot seat between said first and second configurations.

8. A bed system with an excreting mechanism for use by a patient and operable with a bed sheet comprising:

a front base for receiving the upper half of a patient's body, said front base having front and rear portions and side portions and capable of having its front portion tilted upward;

a rear base for receiving the lower half of said patient's body, said rear base having a front portion and being movable forward and backward and having a front portion capable of being tilted upward;

a posture regulating mechanism comprising at least a pair of rollers provided in said front portion of said front base and said rear portion of said front base, respectively; said bed sheet being stretched between said rollers and capable of being moved forward and backward by rotation of said rollers;

a roller drive means for driving said rollers;

a pot seat provided at an opening between said rear portion of said front base and said front portion of said rear base when said front base is tilted up and said rear base is moved backward and said front portion of said rear base is tilted upward; and a chamber pot disposed under said pot seat in such a manner that the upper surface therof is opened and closed when said front portion of said rear base is tilted up or down respectively.

* * * * *